US008127478B2

(12) United States Patent
Blue et al.

(10) Patent No.: US 8,127,478 B2
(45) Date of Patent: Mar. 6, 2012

(54) MESSAGING SIGN HAVING PLATES AND REVERSIBLE LOCKING SYSTEM

(75) Inventors: Gregory Blue, Chester Springs, PA (US); Christopher Heinly, Wyomissing, PA (US)

(73) Assignee: L&H Signs, Inc., Reading, PA (US)

( * ) Notice: Subject to any disclaimer, the term of this patent is extended or adjusted under 35 U.S.C. 154(b) by 208 days.

(21) Appl. No.: 12/369,286

(22) Filed: Feb. 11, 2009

(65) Prior Publication Data

US 2010/0199532 A1 Aug. 12, 2010

(51) Int. Cl.
*G09F 7/00* (2006.01)

(52) U.S. Cl. ..... 40/649; 40/488

(58) Field of Classification Search ..... 40/649, 40/651, 652, 653, 654, 488, 490, 491; 434/405, 434/175, 199

See application file for complete search history.

(56) References Cited

U.S. PATENT DOCUMENTS 362,926 A * 5/1887 Benninghaus ..... 40/653
2,951,301 A * 9/1960 Slavsky ..... 40/653

(Continued)

*Primary Examiner* — Cassandra Davis
(74) *Attorney, Agent, or Firm* — Barley Snyder

(57) ABSTRACT

The invention relates to a nurse messaging system having a rotating cover, which allows the user to move informative indicia plates externally from the frame into a displayed position using a reversible locking system. The messaging sign having a base and a frame, the frame is layered to form slots on an outer surface of the sign and openings on an inner body of the frame. Plates are positioned in the openings and moveable through the slots. Each plate is automatically lockable into a displayed position using a locking member arranged on the frame, and a cover rotatably mounted to the base.

25 Claims, 8 Drawing Sheets

U.S. PATENT DOCUMENTS 3,314,548 A * 4/1967 Stewart ..... 211/85.9
3,604,133 A 9/1971 Hawa
3,824,722 A * 7/1974 Maruscak et al. ..... 40/585
4,682,430 A * 7/1987 Ramsay ..... 40/5
5,253,441 A * 10/1993 Rachiele et al. ..... 40/488
5,257,595 A 11/1993 Cassidy, Jr.
5,608,979 A 3/1997 Johnson
6,658,777 B2 * 12/2003 Dundorf ..... 40/618
6,978,565 B1 12/2005 Tollius
7,263,669 B2 8/2007 Denholm
7,363,738 B2 4/2008 Burtch
2001/0045037 A1 11/2001 Bank et al.
2003/0029064 A1 2/2003 Gordon et al.
2006/0225324 A1 10/2006 Culiver

* cited by examiner

MESSAGING SIGN HAVING PLATES AND REVERSIBLE LOCKING SYSTEM

FIELD OF THE INVENTION

The invention relates to a messaging sign, in particular, it relates to a signage system having a rotating cover, which allows a user to move informative indicia plates externally from the frame, and lock them into position using a reversible locking system.

BACKGROUND

Improving the overall quality of patient care has become a fundamental priority for healthcare providers. In order to provide utmost care, providers rely heavily on accurate communication between a patient and staff members, as well as directives between staff members. A breakdown of this communication may not only lead to irritable patients, but potentially fatal consequences.

Generally, various staff members attend to a patient's needs, including doctors, nurses and other hospital employees. The interchanging responsibility between each staff member requires clear verbal and visual communications to minimize confusion and miscommunication. Proper communication not only benefits the patient, but also the attending staff members and other neighboring patients, since it may be important to communicate any potential communicable illnesses that patient may have.

There has always been a problem in communicating patient care in a concise consistent manner. Although instructions and patient information may be shared on charts, computers and handwritten panels, the attending staff member may not have the time or understanding of the scribed remarks. In fact, the attending staff may have to rely on many different references, in various locations, in order to treat a patient. Communicating important information, in this manner, may not necessarily be efficient.

The healthcare industry, like many other industries, has adopted a simplistic system of universal indicia representing important directives. This system allows staff members to inform healthcare professionals of patient needs and concerns in a clear efficient manner.

Because it is normal for a nurse to transfer patient information to another incoming nurse during a shift change, nurse messaging signs have become popular because they provide informative directives using predetermined symbols. Such systems provide an incoming nurse or attending doctor enough information needed to provide particular patient care without having to review numerous records. It may be important not to disrupt the patient's privacy, and so the messaging sign may provide the attending staff with advance warning. Fundamentally, these signs have become popular because they provide patient care instructions, such as medical warnings, in a consistent, effective manner.

U.S. Patent Application Publication No. 2001/0045037 discloses a patient care and medical alert system, which includes a message board for displaying information. The message board comprises a frame and cover, wherein the cover includes a permanent and temporary message area, and is free to rotate away from the frame. The permanent message area includes indicia relating to the permanent identifying information, including, but not limited to, a room number, wing and telephone extensions. The temporary message area is left available so that a user can use temporary message cards to detail temporary messages about a patient. The user can rotate the cover to an open position, in order to access a recessed portion of the frame. This recessed portion is configured and dimensioned in order to store a number of temporary message cards. The temporary message cards contain distinct indicia relevant to the care of the patient identified on the message board and can be affixed to the cover. The temporary message cards can be attached using a variety of fastening means, including, but not limited to, magnets, hook and loop, and adhesives. This type of signage system allows a nurse to provide a litany of information about the patient, but is dependent on message cards, which can be misplaced or removed very easily.

U.S. Patent Application Publication No. 2003/0029064 discloses a placard apparatus for display in a room for visually informing responding emergency personnel the occupant safety status. The placard apparatus comprises a front, middle and rear planar members, as well as slideable signage members. When assembled, the front, middle and rear planar members will house the slideable signage members in a formed slot area. The front planar member includes two apertures, one which is on the right edge and the other on the left edge. Additionally, the front planar member includes a central portion having indicia. The middle planar member acts as a spacer between the front and rear planar members, and has as large opening in the center. This acts as the slot area when the apparatus is assembled. The signage member, which includes indicia on the right and left sides, fits between the large opening. The user can move the signage member left or right to expose the appropriate indicia through the corresponding aperture. The signage member is designed to fit snug between the top and bottom edges of the middle planar member. However, the signage member is only wide enough to be viewed through one aperture when fully pushed up against the left or right side of the middle planar member. The middle planar member and signage member include features that comprise a latching system. This latching system locks the signage member into place when the user fully exposes information from the signage member through the right aperture, and a signage member notch becomes engaged with the latching system. A rear planar member, which has a narrow slotted opening, completes the placard system. This slotted opening provides the user access to the signage member in order to move and lock the signage member into place. This type of signage system is very limited in application, especially considering that the suggested latching system is not reversible.

U.S. Pat. No. 3,604,133 discloses an advertising card display comprising a plurality of cards enclosed within a hollow rectangular sleeve. The cards may contain text or symbols, in order to communicate information to a viewer. Each card has a pull tab means enabling the cards to be grasped and pulled from the left or right side of the sleeve. Projections on the leading end of the cards provide foot rest means for the cards, while the card is in displayed position. Projections on the trailing end serve as a means to prevent the cards from being withdrawn completely from the sleeve. Since the cards are stacked on each other in the sleeve, the rectangularly configured strips provide a stopping engagement with adjacent cards. The strips are secured on both sides of the leading end of the card. This acts a second stopping means. When one card is pulled out of the sleeve, the strip on other adjacent card acts to stop the pulled card from being completely removed from the sleeve. When the adjacent card is then pulled out in the opposite direction, the locking engagement automatically pulls the exposed card back into the sleeve. Several embodiments are further disclosed, but are all similar in operation. A problem exists with these designs in that the cards can be repositioned without a user unlocking the card first. The card being displayed can be accidentally removed from view, having serious repercussions.

SUMMARY

It is an object of the present invention to provide a messaging system having a rotating cover, which allows the user to move informative indicia plates externally from the frame into a displayed position using a reversible locking system.

It is further an object of the invention to provide a messaging sign apparatus having a base and a frame, the frame is layered to form slots on an outer surface of the sign and openings on an inner body of the frame. Plates are positioned in the openings and moveable through the slots. Each plate is automatically lockable into a displayed position using a locking member arranged on the frame, and a cover rotatably mounted to the base.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Figure 1:
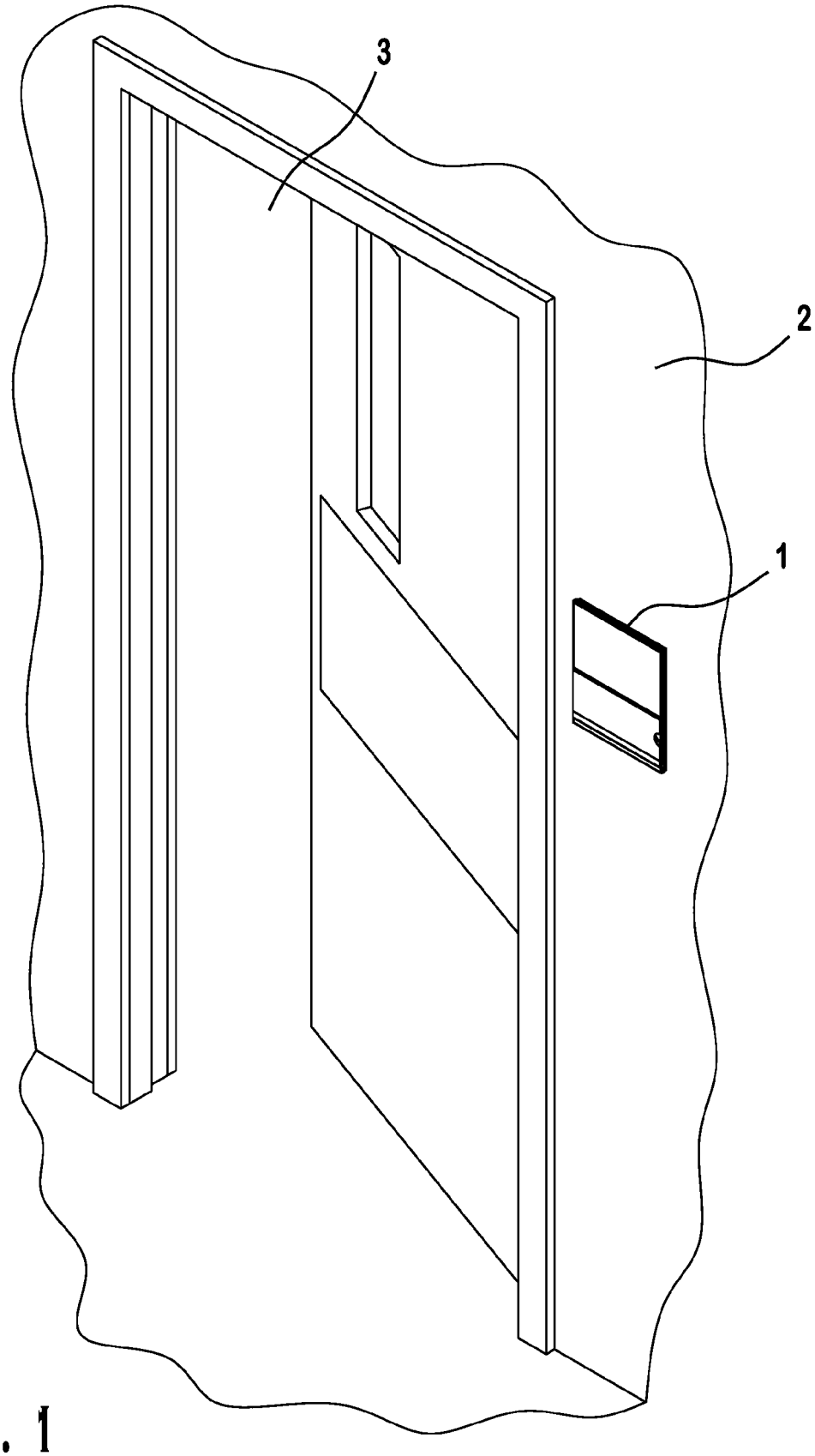
FIG. 1 is a perspective view of a messaging sign mounted to a wall outside a patient's room.

Referring first to FIG. 1, an embodiment of the present invention is a messaging sign 1, which, in this example attaches to a wall 2 outside of a patient's room 3. However, the messaging sign 1 is capable of attaching to any surface necessary to communicate patient care to other nurses, hospital personnel, or patient visitors. Those skilled in the art will appreciate that the messaging sign 1, although show here in a patient care application, has other fields of use wherever changing information needs to be communicated. In the embodiment, the messaging sign 1 attaches to the wall 2 using adhesive tape on the rear side (not shown) of the messaging sign 1.

Figure 2:
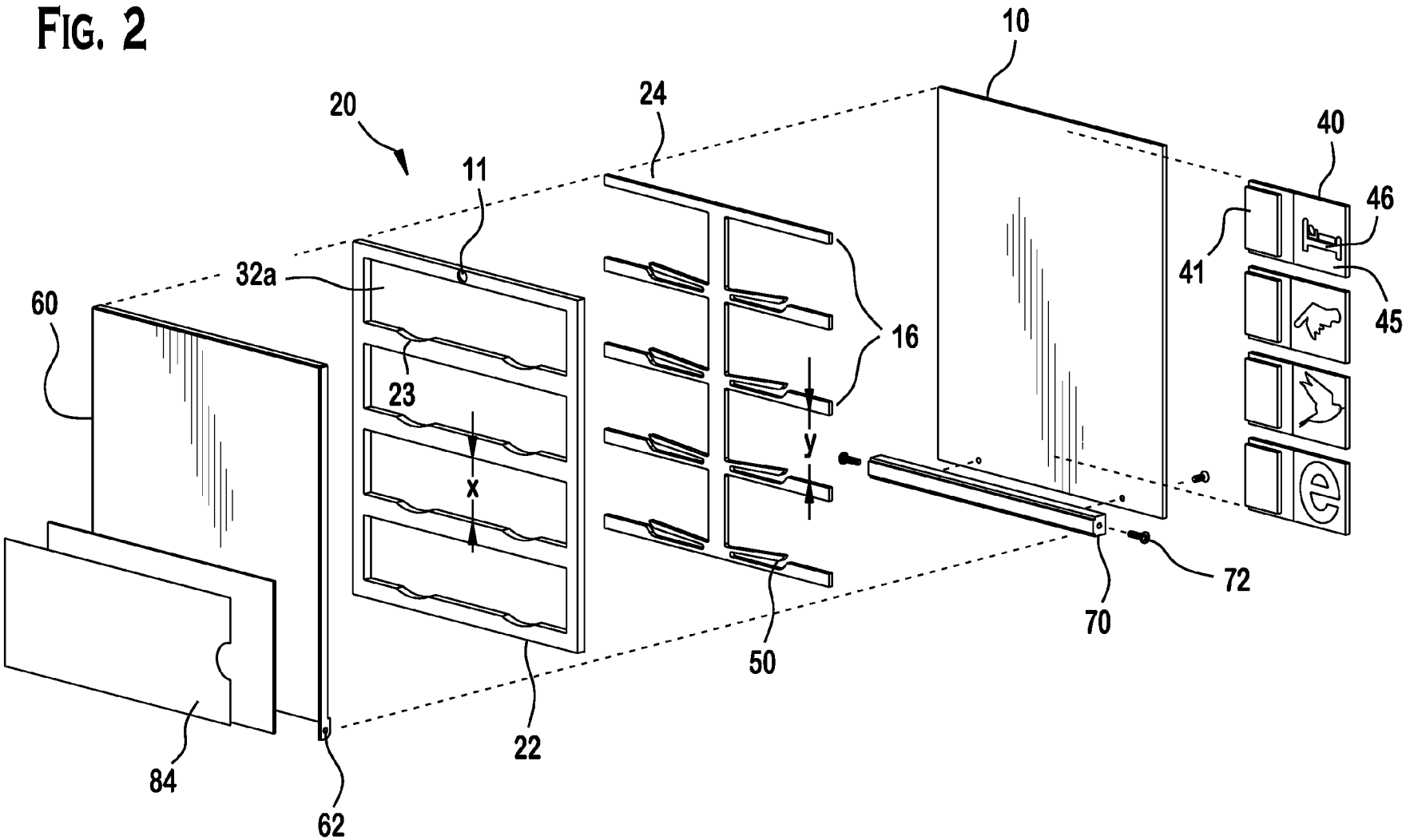
FIG. 2 is an exploded perspective view of the messaging sign.

FIG. 2 illustrates the major components of the messaging sign 1, which includes a base 10, a frame 20 formed from a top layer 22 and a middle layer 24, a cover 60, plates 40, and locking members 50 formed on the middle layer 24 of the frame 20. Each of the major components will be described in further detail below.

Figure 3:
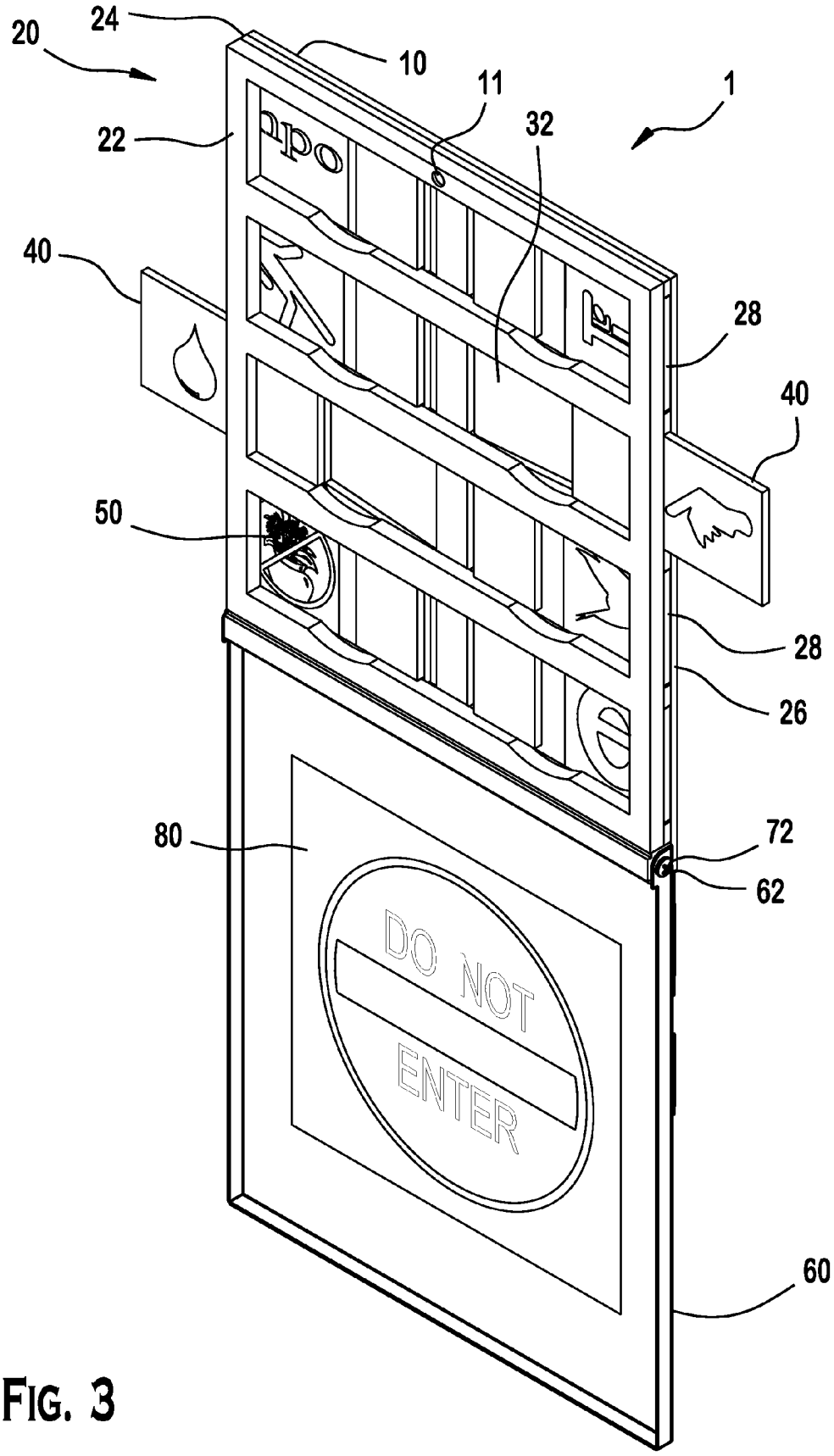
FIG. 3 is a perspective view of the messaging sign, with the cover rotated to a open position.

As illustrated in FIG. 3, the base 10 and the frame 20 connect to form openings 32 within an inner body of the frame 20, as well as slots 28 on the outer wall 26 of the frame 20. The base 10 and frame 20 can be connected using any fastening means known to one skilled in the art. However, in the embodiment shown, the base 10 and the frame 20 are connected using an adhesive (not shown). These individual components are best viewed in FIG. 2.

In the embodiment illustrated in FIG. 2, the base 10 is constructed as a rigid rectangular panel. A mounting means is found on a rear surface (not shown in FIG. 1) of the base 10, which can facilitate either permanent or temporary attachment of the base 10, or the messaging sign 1 when fully constructed, to any desired surface. The mounting means may be double-sided adhesive tape (not shown). However, it is possible to use screws, rivets, Velcro, etc, in order to attach the base 10 to a desired surface. The base 10 may be constructed using any material that is rigid enough to hold the overall weight of the messaging sign 1.

The frame 20 is constructed using layers. In the embodiment shown, a top layer 22 and a middle layer 24, are constructed using plastic or composite materials. However, it is also possible to construct the frame 20 layers 22, 24 using other materials, such as metal or wood. The top and middle layers 22, 24 are formed as rigid rectangular panels, with specific apertures formed on an inner body of each layer 22, 24. However, each layer 22, 24 is constructed having the same width dimensions as the base 10, but the layers 22, 24 lengths are a length shorter than the base 10. In fact, the overall length of the layers 22, 24, which make up the frame 20, will be determined by the overall dimensions of an attachment block 70 that will become fixed to the bottom portion of the base 10 when the messaging sign 1 is assembled.

Prior to sign 1 construction, the top layer 22 is formed to include a plurality of rectangular cavities 32*a*, which extend in a latitudinal axis of the top layer 22, as well as a plurality of notches 23 along a bottom portion of each cavity 32*a*. Each notch 23 is formed on a left side and a right side of each cavity 32*a*, according to the embodiment shown. The top layer 22 may be constructed using a variety of methods, including injection molding, metal stamping, etc. but must be in a manner sufficient to form the rectangular cavities 32*a* and notches 23.

The middle layer 24 of the frame 20 is constructed and formed in a grid shape, having a plurality of dividers 16 extending in the latitudinal axis and a single inner stringer 25, formed along a substantially center part of the middle layer 24, and extending along a longitudinal axis of the middle layer 24. The dividers 16 are connected to each other using the single inner stringer 25, leaving no external walls between each divider 16.

As illustrated in FIGS. 2, 3, 4*a* and 4*b*, the top layer 22 assembles on top of the middle layer 24, forming the frame 20. The middle layer 24 grid shape will match up with the rectangular cavities 32*a* of the top layer 22, with the inner stringer 25 dividing the rectangular cavities 32*a* of the top layer 22 into substantially two smaller openings 32 of the frame 20's inner body.

The height x of the rectangular cavities 32*a*, formed in top layer 22, is smaller than the distance y between dividers 16 of the middle layer 24. This allows the plates 40 to be well received within the formed openings 32 of the frame 20. The difference in dimensions between opening 32 of the top layer 22 and the distance between the dividers 16 should be appropriate in order to prevent the plates 40 from falling out of the openings 32 when received between the dividers 16 of the middle layer 24, and formed slots 28 as shown clearly in FIG. 3.

The plates 40 are constructed, using the same materials as the frame 20. However, other materials are possible, as long as the material is rigid enough so the plates 40 do not deform during extended use. Each plate 40 is rectangular, and is substantially the same thickness as the middle layer 24 of the frame 20. The height z of the each plate 40 should be marginally smaller than the distance y between each divider 16, yet larger than the height x of the formed openings 32 of the top layer 22. The plate 40 should have a width b that is substantially as long as the width c that is measured from an inner surface 27 of the stringer 25*a* to an extending end of the divider 16*b*.

Figure 5:
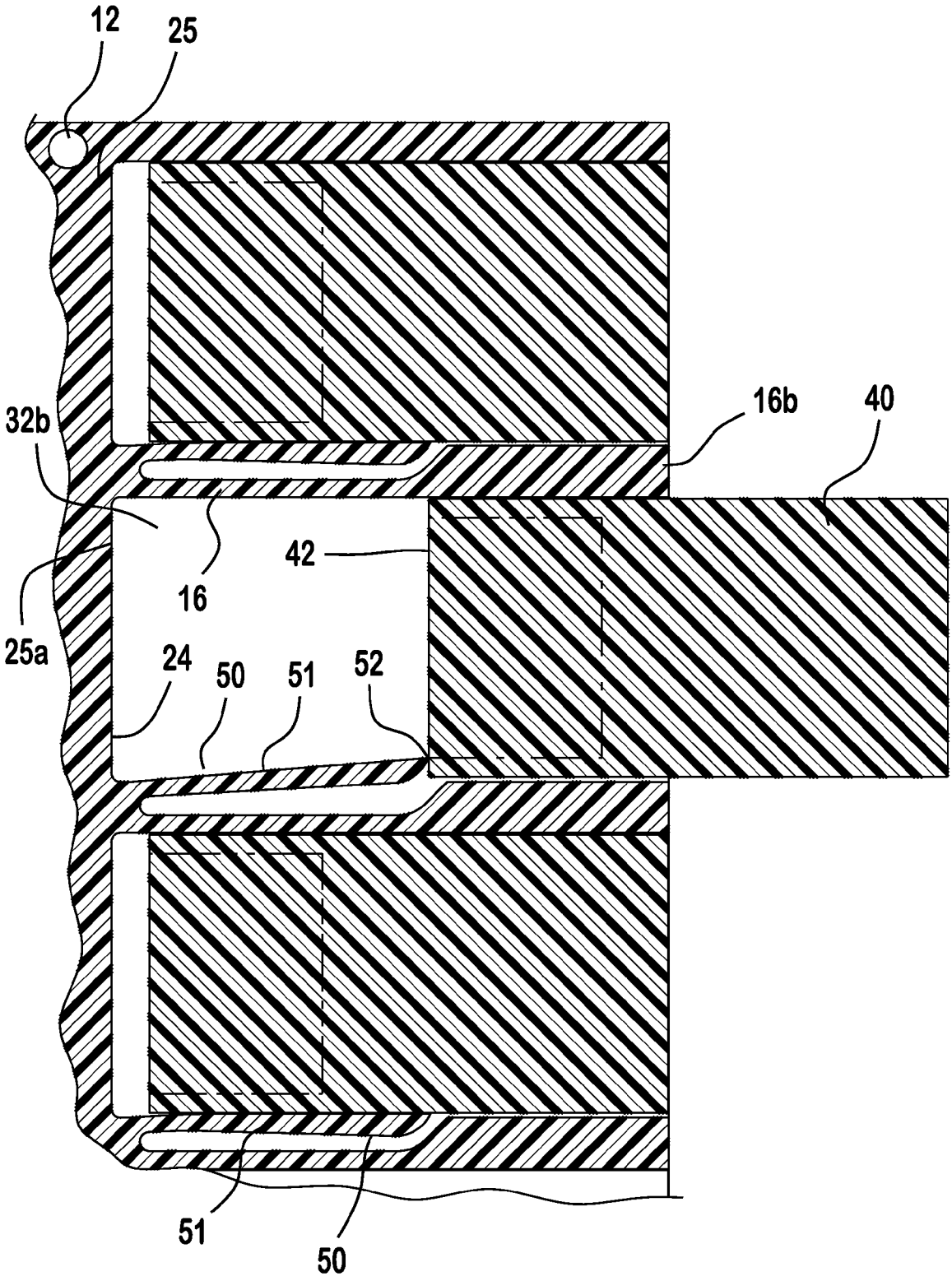
FIG. 5 is a close-up frontal view of the messaging sign, showing a locking member construction and how the locking member resiliently biases a leading end of the indicia plate, when the indicia plate is in the displayed position.

As is illustrated in FIG. 5, the plate 40 should be well received by recess 32*b* formed by the grid like shape of the middle layer 24. Therefore, the plate 40 is secure, but is also capable of freely moving in a linear direction. The difference in height z of the plate 40 and distance y between dividers 16 should be minimized in the embodiment shown, that way the plate 40 may smoothly slide between the dividers 16 when received.

Referring back to FIG. 2, four plates 40, on each side of the sign 1, are illustrated having indicia 46 fixed to a surface of each plate 40. In the embodiment shown, the indicia 46 are selected to be symbols standard to the health care industry. However, it is possible to include any symbol or text desired by a user in any industry. The indicia 46 can be fixed to the plate surface 45 either permanently or temporarily, pre-assembly or during operation. On the trailing end 42 of each plate 40 is a block protrusion 41 that is permanently attached to the plate 40. This block protrusion 41 is constructed using the same material as the plates 40 and the frame layers 22, 24. Once again, any material desired may be used to any component discussed.

Once the sign 1 is constructed, each block protrusion 41 is used to prevent the plates 40 from being fully removed from the formed slots 28, specifically when the plate 40 to a displayed position. The function of the block protrusion 41 will be discussed in further detail below.

As clearly shown in FIGS. 2 and 5, the locking member 50 is constructed using from the divider 16 of the middle layer 22. In the embodiment shown, a locking member 50 is formed on each side of each divider 16, except the top most divider 16. The top most divider 16 should make up the top portion of the frame 20.

The locking member 50 includes a resilient finger 51 and finger end 52, where the locking member 50 is attached to the middle layer 22 at the opposite end of the finger end 52. The locking member 50 is resiliently bias away from the divider 16 and toward a received plate 40. The divider 16 is manufactured in such a way to provide locking members 50 on the both left and right sides of the divider 16, where each locking member 50 being separated by the inner stringer 25, when the frame 20 is assembled.

In the embodiment shown, the locking member 50 should be formed to engage each plate 40 of the sign 1. The locking member 50 may either be an integral component of middle layer 24, or constructively attached to the middle layer 24.

FIG. 3 illustrates the cover 60, which is constructed as a rectangular shaped box. The cover 60 is dimensioned so that the cover 60 can mutually receive a dimensioned frame 20 when the cover 60 is in a closed position (as shown in FIG. 6).

According to the invention, the frame 20 is fully received into an inner portion 61 of the cover 60, when the cover 60 is rotated to a closed position. The inner portion 61 of the cover 60 should have an inner depth substantially equal to thickness of the frame 20 to accomplish this feat.

Figure 6:
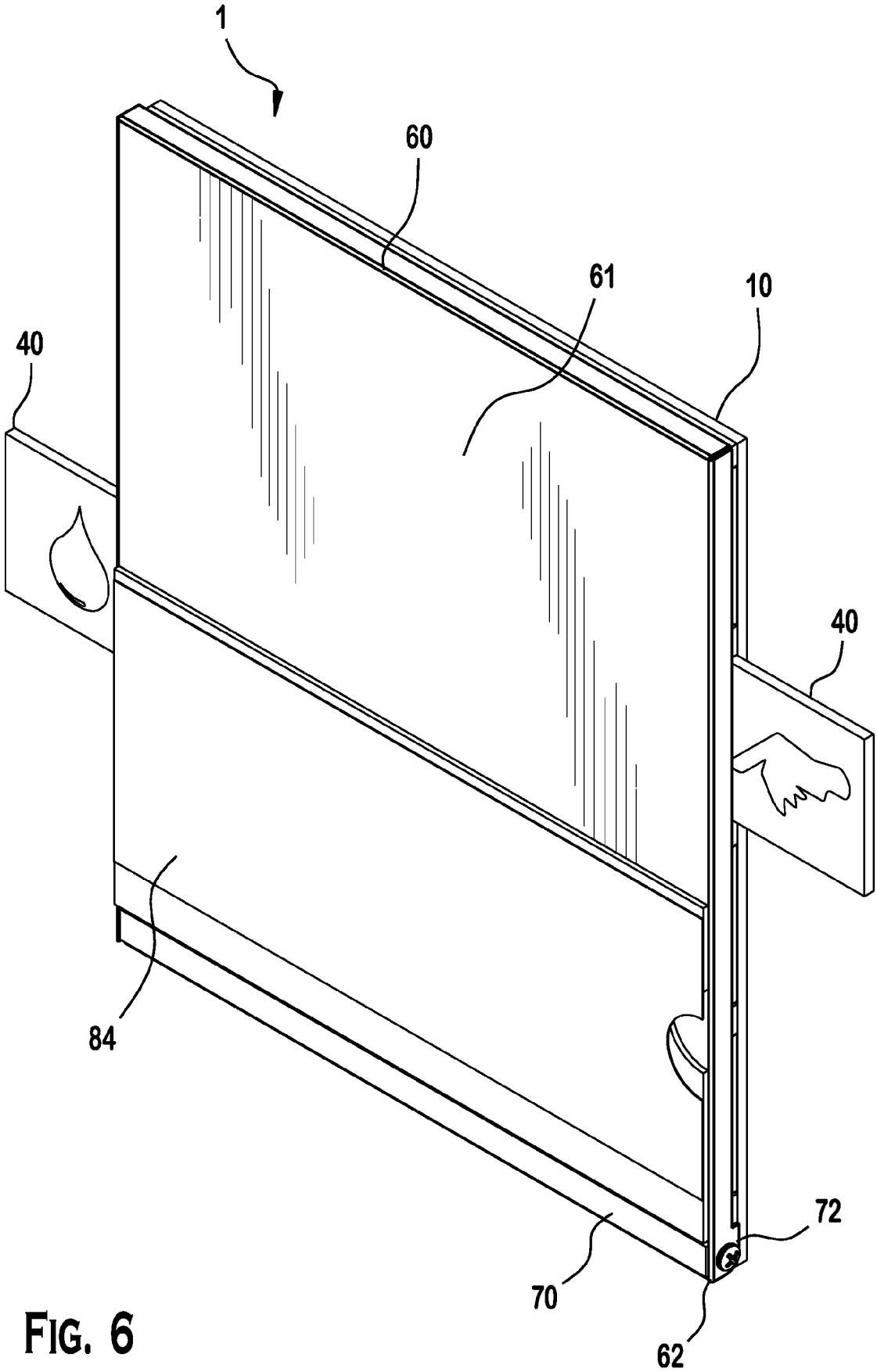
FIG. 6 is a perspective view of the messaging sign, with the cover rotated to an closed position.

As shown in FIGS. 2, 3, and 6, the cover 60 includes extensions 62, extending from the bottom of the cover 60, preferably a distance conforming to the height dimensions of the attachment block 70. The extensions 62 are formed, as tabs on the cover 60, extending along as longitudinal axis of the cover 60. Each extension 62 includes a receiving hole to receive a fastener 72. The fastener 72 then attaches to the attachment block 70. The attachment block 70 attaches to the base 10 as well, enabling the cover 60 to be rotatably mounted to the messaging sign 1.

In the embodiment shown, the fastener 72 is constructed as a screw that attaches to the attachment block 70 through the receiving hole in the extension 62. The cover 60 may be constructed of metal, however, the cover 60 can be fabricated using a variety of materials known to the art. A metal cover 60, permits magnetic articles, such as a removable sign 80, to be temporarily fixed to the surface of the cover 60.

The removable sign 80 may be housed on the inside surface of the cover 60, and placed on outer surface of the cover 60 when desired. Therefore, the removable sign 80 permits further communication when the sign 1 is in a displayed position.

The removable sign 80 is magnetic in the embodiment shown, however, the removable sign 80 may attach to the inner or outer surfaces using a variety of securing means, such as Velcro, static, adhesive, etc. as well.

Referring back to FIG. 2, the messaging sign 1 is constructed by first attaching the top layer 22 to the middle layer 24. Specifically, a rear surface of the top layer 22 is permanently attached to a front surface of the middle layer 24. Further, the top most divider 16 should assemble substantially parallel with the upper most portion of the top layer 22. Hence, both layers 22, 24 should come together to form a single frame 20, having parallel sides. A securing device 11, for example, a magnet may be provided on the top surface of the top layer 22. This securing device 11 may be used to secure the cover 60, when rotated to a closed position.

In the embodiment shown, and as shown in FIG. 3, the frame 20 and base 10 assembly provides slots 28 on the outer surface of the outer wall 26 of the frame 20. The slots 28 may fully receive the plates 40 into the further formed openings 32 of the frame 20. The base 10, in this assembly, operates as a floor, as the dividers 16 act as walls, so the plate 40 may slide in and out of the opening 32.

Figure 7:
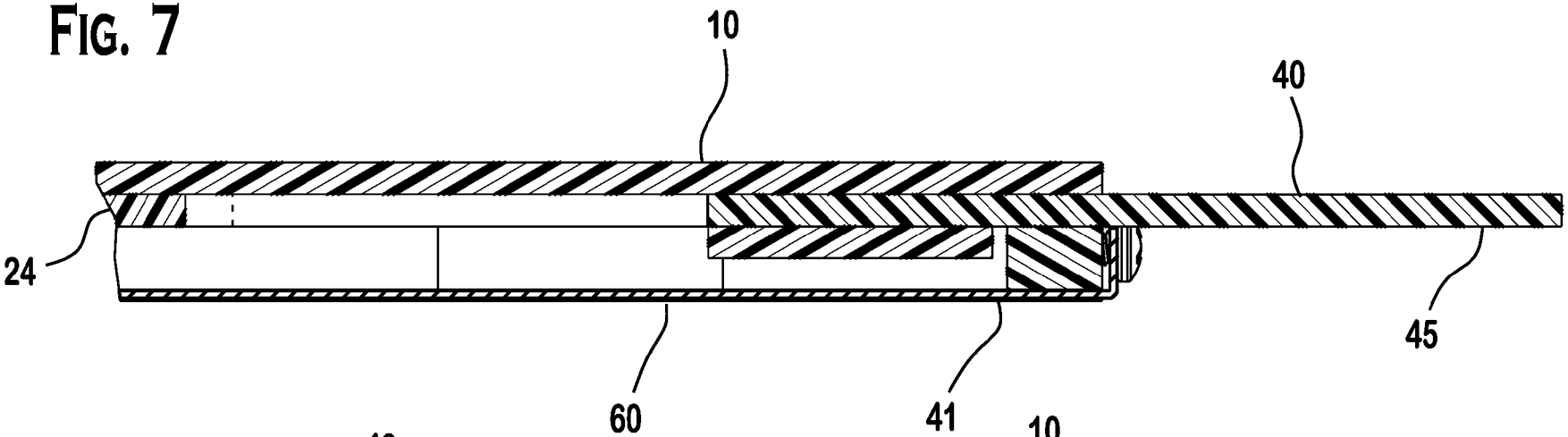
FIG. 7 is a section view of the messaging sign, from the top, showing how the indicia plates fit between a base and top layer of the frame, and are capable of sliding through a formed slot to a displayed position.
Figure 8:
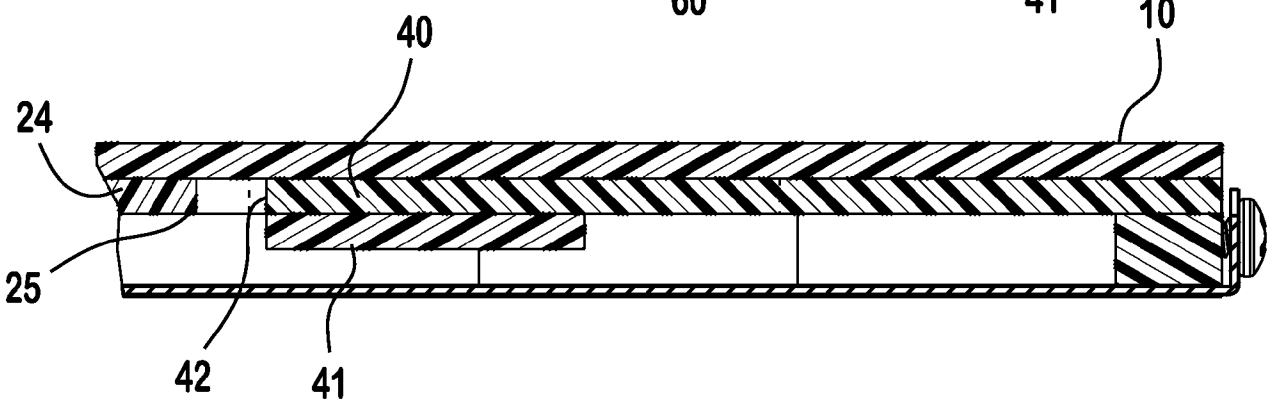
FIG. 8 is a section view of the messaging sign, from the top, showing how the indicia plates fit between a base and top layer of the frame, and are capable of sliding through a formed slot to a concealed position.

FIGS. 5, 7 and 8 clearly illustrate how each plate 40 received into the opening 32, and slideable between a displayed (FIG. 7) or retracted (FIG. 8) position. As discussed above, the plate 40 should be well received by the slot 28 and opening 32, where the plate 40 has little room to wiggle when moving from a retracted to displayed positions.

Figure 4A:
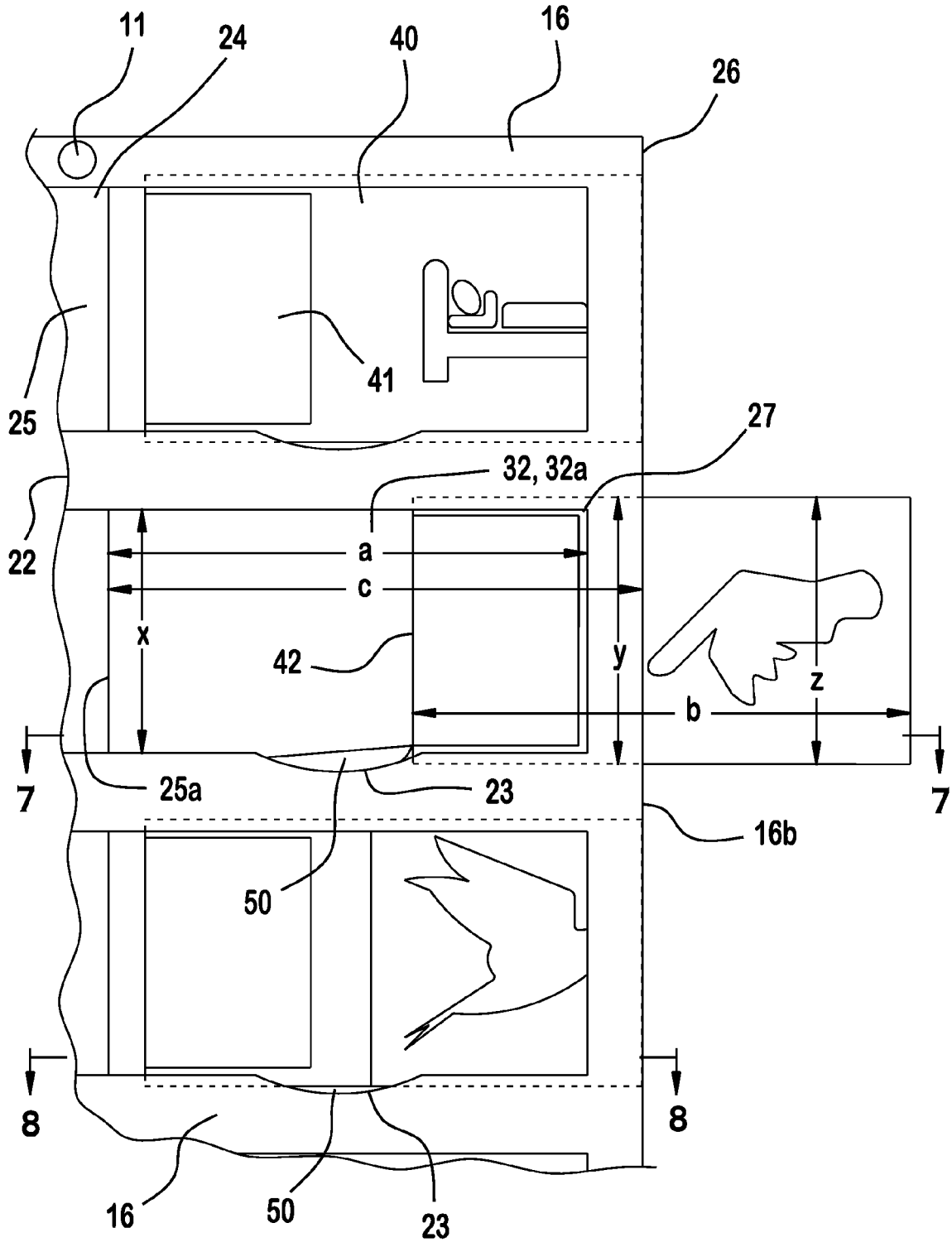
FIGS. 4*a* and 4*b* are close-up frontal views of the messaging sign, showing how the indicia plates fit between a base and top layer of the frame, and are capable of sliding through a formed slot to a displayed position.
Figure 4B:
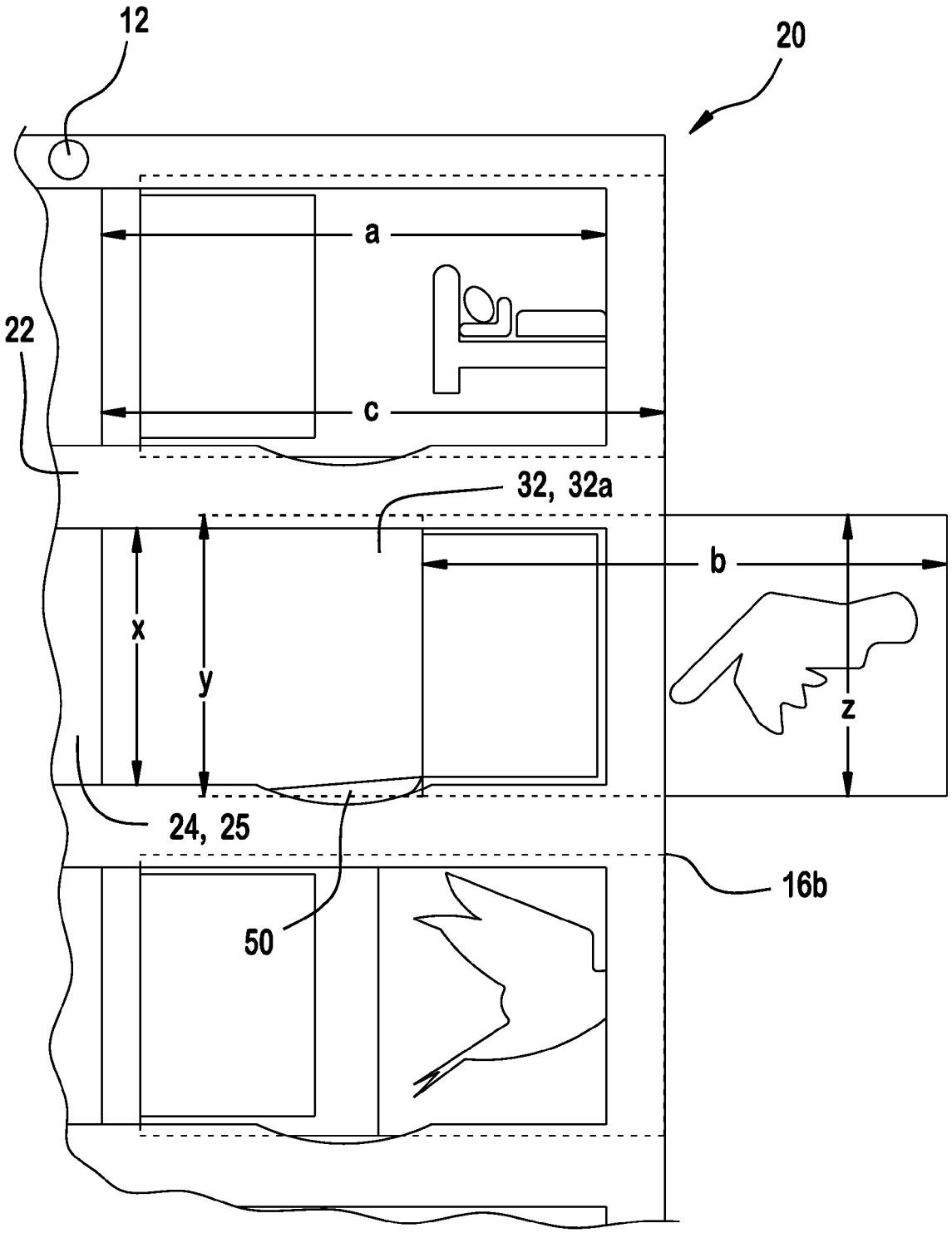

FIGS. 4*a* and 5 show that locking member 50 should be depressed before the plate 40 can fully slide into the opening 32, at which point the trailing end 42 of the plate 40 abuts the outer surface 25*a* of the inner stringer 25. As discussed above, the plate 40 height z is larger than the height x of the top layer cavity 32*a*. This maintains that the plate 40 stay within the opening 32 between the top layer 22 and the base 10. Once the plate 40 is positioned in a retracted position, the block protrusion 41 is permanently attached to the plate 40. The block protrusion 41 dimensions will be consistent with the height x of the top layer cavity 32*a*. As discussed above, the block protrusion 41 is the same thickness as the top layer 22, as well. Therefore, when the plate 40 is positioned in the slot 28 and assembled with the block protrusion 41, the plate 40 will be confined to slot 28 and opening 32 formed by the frame 20 and base 10 assembly.

As discussed above, the cover 60 is rotatably mounted to the base 10 using an attachment block 70, as clearly illustrated in FIG. 2. The attachment block 70 is first connected to a region below the frame 20. The region's dimensions are adjustable, and is only determined by the size of the attachment block 70. The attachment block 70 is dimensioned in order to properly support the cover 60, which depends on construction material and overall sign 1 size. The cover 60 has extensions 62, which are also dimensioned according to the attachment block 70. The attachment block 70 secures to the base 10, preferably using several screws. However, the attachment block 70 could be attached to the base 10 using a variety of securing means, including thermosets, mechanical connections, etc. As discussed above, the cover 60 connects to the attachment block 70 with a fastener 72, guided through a receiving hole of the extension 62, and securing to the attachment block 70.

In operation, a user rotates the cover 60 to the open position, as shown in FIG. 3. The user then determines which plates 40 should be exposed, depending upon the desired or required indicia 46. The user displays a plate 40 by pushing the plate 40 through the slot 28 using the block protrusion 41. As discussed, the block protrusion 41 will not let the user accidentally or purposely remove the plate 40, because the block protrusion 41 can only move between the inner stringer 25 and the inner surface 27 of the outer wall 26 of the frame 20 (see FIG. 5 as well). When the plate 40 is positioned into a displayed position, the plate 40 fully exposes the selected indicia 46. The nurse will know when the plate 40 is in the displayed position, because the locking member 50 will automatically engage the plate 40.

The locking member 50, which is resiliently biased to the plate 40, moves upward so that the resilient finger end 52 of the locking member 50 abuts the trailing end 42 of the plate 40. Displaying a plate 40 can therefore be easily accomplished with one hand.

FIG. 3 also shows a removable sign 80, which may be housed on the inside of the cover 60. Although the embodiment shows only one removable sign 80, it is possible to provide the user with a plurality of removable signs 80. If the user finds a need to use the removable sign 80, the user can remove the removable sign 80 and attach to the outer surface of the cover 60.

Once the user has selected the indicia 46 required, and further positioned the selected plates 40 to a displayed position, the user may rotate the cover 60 to the closed position (as clearly shown in FIG. 6). Since the locking member 50 engages the plates 40 into position a displayed position, a person cannot accidentally reposition the displayed plate 40 to a retracted position without first opening the cover 60, and then disengaging the locking member 50.

Additionally, the cover 60 further prevents accidental movement of the plates 40 from retracted position to a displayed position. Rotating the cover 60, from an open position to a closed position, and vice-versa, can be easily performed easily with one hand.

To change the displayed indicia 46, the cover 60 is rotated back into the open position. The locking member 50 may then be pressed downward into the unlocked position. When the user depresses the locking member 50, the resilient finger end 52, of the locking member 50, disengages with the trailing end 42 of the plate 40. The notch 23 helps facilitate further depression of the locking member 50, and smoother transition of the plate 40 from a displayed position to a retracted position.

Once the locking member 50 disengages with the plate 40, the plate 40 may be pushed back through the slot 28 and into the base opening 32. Disengagement and movement of the plate 40 may be performed with one hand, wherein one finger (not shown) presses the locking member 50 downward as another finger (not shown) pushes the plate 40 back through the slot 28 and into the opening 32. As discussed above, the inner stringer 25 limits the free-motion of the plate 40 to another side of the sign 1, by abutting the trailing end 42 of the plate 40. The cover 60 is closed again until further operation of the plates 40 is required.

In another embodiment, the cover 60 includes a card slot 84 attached to the outer surface of the cover 60, as shown in FIG. 2. The card slot 84 can be used to hold paperwork (not shown) concerning the patient or further indicia 46 cards (not shown) that may be displayed on the outer surface of the caver.

The foregoing illustrates some of the possibilities for practicing the invention. Many other embodiments and fields of use for the messaging sign are possible and within the scope and spirit of the invention. It is, therefore, intended that the foregoing description be regarded as illustrative rather than limiting, and that the scope of the invention is given by the appended claims together with their full range of equivalents.

What is claimed is:

1. A messaging sign apparatus comprising:

a base;

a frame, being layered to form slots on an outer surface of the sign and openings on an inner body of the frame;

plates positioned in the openings and moveable through the slots to a displayed positioned opposite the opening;

a locking member arranged on the frame;

each plate being lockable into the displayed position; and an opaque cover rotatably mounted to the base and covering the openings.

2. The apparatus of claim 1, wherein the frame further comprises several layers to form the openings.

3. The apparatus of claim 2, wherein the layers comprise a top layer having formed rectangular openings and notches and a middle layer having dividers and an inner stringer.

4. The apparatus of claim 1, further comprising an attachment block and fasteners, wherein the attachment block connects to the base and to the cover using fasteners.

5. The apparatus of claim 1, further comprising at least one securing device, provided in the top layer.

6. The apparatus of claim 1, further comprising a mounting means on the rear surface of the base.

7. The apparatus of claim 2, wherein the mounting means is an adhesive.

8. The apparatus of claim 1, wherein the plates include industry recognized indicia on a face of the plate.

9. The apparatus of claim 1, wherein each plate further comprises a block protrusion on an inner side of each plate arranged to engage an inner wall of the frame when the plate is positioned into a displayed position, and abut an inner stringer of the frame when the plate is in a retracted position.

10. The apparatus of claim 1, wherein the locking member is moveable between a locked position and an unlocked position.

11. The apparatus of claim 1, wherein the cover comprises an outer surface, an inner surface, and at least one removable sign stored on the inner surface and attachable to the outer surface.

12. The apparatus of claim 11, wherein the removable sign is magnetically attached.

13. The locking member of claim 1, further comprising a flexible finger cut from the frame and resiliently bias away from frame and the toward the plate, abutting a trailing end of the plate when in a displayed position.

14. A method for improving communication of patient care instructions to staff, comprising:

attaching a messaging sign near a patient's room;

opening a cover which is rotatably mounted to a base of a signage member;

selecting from a plurality of instructional indicia arranged on numerous plates, each plate having a different symbol for patient care;

moving selected plates from an opening on an inner body of a layered frame through a slot on an outer surface of the frame to a displayed position, wherein the plates become exposed outside of the signage system; and closing the cover member, whereby only the selected plates appear visible for patient care instruction.

15. The method of claim 14, further comprising the step of:

removing a removable sign from an inner surface of the cover member and attaching to a front surface of the cover member.

16. The method of claim 15, further comprising the steps of:

re-opening the cover member and deciding which indicia plates remain in the displayed position;

depressing a locking member associated with a selected one of the plates no longer desired for patient care, and advancing the selected plate back through the slot into the opening with one hand;

selecting from a plurality of instructional indicia arranged on numerous plates, each plate having a different symbol for patient care;

moving selected plates from the opening through the slot to a displayed position, wherein the plates become exposed outside of the signage system; and closing the cover member, whereby only the selected plates appear visible for patient care instruction.

17. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position;

a cover rotatably mounted to the base; and an attachment block and fasteners, wherein the attachment block connects to the base and to the cover using fasteners.

18. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position;

a cover rotatably mounted to the base; and at least one securing device, provided in the top layer.

19. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position;

a cover rotatably mounted to the base; and a mounting means on the rear surface of the base.

20. The apparatus of claim 19, wherein the mounting means is an adhesive.

21. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position; and a cover rotatably mounted to the base;

wherein each plate further comprises a block protrusion on an inner side of each plate arranged to engage an inner wall of the frame when the plate is positioned into a displayed position, and abut an inner stringer of the frame when the plate is in a retracted position.

22. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position; and a cover rotatably mounted to the base;

wherein the locking member is moveable between a locked position and an unlocked position.

23. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position; and a cover rotatably mounted to the base;

wherein the cover comprises an outer surface, an inner surface, and at least one removable sign stored on the inner surface and attachable to the outer surface.

24. The apparatus of claim 23, wherein the removable sign is magnetically attached.

25. A messaging sign apparatus comprising:

a base;

a frame, being layered to form slots on an outer surface of the sign and openings on an inner body of the frame;

plates positioned in the openings and moveable through the slots;

a locking member arranged on the frame;

each plate being lockable into a displayed position;

a cover rotatably mounted to the base; and a flexible finger cut from the frame and resiliently bias away from frame and the toward the plate, abutting a trailing end of the plate when in a displayed position.

* * * * *